US005415096A

United States Patent [19]

Koch et al.

[11] Patent Number: 5,415,096

[45] Date of Patent: May 16, 1995

[54] DEVICE FOR CORRECTING TRAPEZOIDAL REGISTER DEVIATIONS

[75] Inventors: Manfred Koch, Sandhausen; Wilfried Vogt, Walldorf, both of Germany

[73] Assignee: Heidelberger Druckmaschinen AG, Heidelberg, Germany

[21] Appl. No.: 948,014

[22] Filed: Sep. 21, 1992

[30] Foreign Application Priority Data

Sep. 20, 1991 [DE] Germany ..... 41 33 368.3
Jan. 16, 1992 [DE] Germany ..... 42 00 942.1
Aug. 7, 1992 [DE] Germany ..... 42 26 192.9

[51] Int. Cl.[6] ..... B41F 27/06
[52] U.S. Cl. ..... 101/415.1
[58] Field of Search ..... 101/415.1, 378, 409, 101/410

[56] References Cited

U.S. PATENT DOCUMENTS 3,903,796 9/1975 Jeschke et al. ..... 101/415.1
4,831,931 5/1989 Jeschke et al. ..... 101/415.1
5,094,165 3/1992 Sugiyama et al. ..... 101/415.1
5,199,352 4/1993 Sugiyama ..... 101/415.1

FOREIGN PATENT DOCUMENTS 0493772 7/1992 European Pat. Off. .
2310228 3/1976 Germany .

*Primary Examiner*—J. Reed Fisher
*Attorney, Agent, or Firm*—Herbert L. Lerner; Laurence A. Greenberg

[57] ABSTRACT

A device for correcting trapezoidal register deviations, which includes clamping a trailing edge of a printing plate on a plate cylinder at a plurality of partial sections thereof, making a specimen print for determining register deviations, and correcting register deviations by changing lateral spacing of two of the partial sections engaged in the clamping, and prior to correcting the register deviations, applying an additional clamping force to the two partial sections, the lateral spacing of which is changed; and a device for performing the method.

16 Claims, 12 Drawing Sheets

DEVICE FOR CORRECTING TRAPEZOIDAL REGISTER DEVIATIONS

SPECIFICATION

The invention relates to a method for correcting trapezoidal register deviations which includes clamping a trailing edge of a printing plate at least at two partial sections, making a specimen print for determining register deviations, and correcting register deviations by changing lateral spacing of two of the partial sections engaged in the clamping.

The invention further relates to a device for performing this method, including an attachment rail for clamping a trailing edge of a printing plate, the attachment rail having a tensioning rail and a clamping rail and being formed of at least two component rail parts of which one part is displaceable by an adjusting device for changing lateral spacing.

It has become known heretofore from German Patent 23 10 228 to correct trapezoidal register deviations by providing printing plates with two clamping regions at the respective trailing edges thereof, and a stretching length lying therebetween is stretched by means of changing the lateral spacing of the two clampings. A shortening of the printing plate is also possible, in this manner, although this type of correction is quite less commonly necessary.

The background of such a correction is rolling-down of paper sheets with the result that these, at each printing in a printing unit, are somewhat more trapezoidally rolled-down at the trailing end thereof. For types of paper which are inclined towards such a rolling-down, it is necessary, then, to spread the printing plates of the individual printing units with the extent of rolling. The solution heretofore known in the state of the art, such as in the aforementioned German patent, affords a clamping of the printing plate with exceptionally great holding force because the expansion of an aluminum plate requires a high tension force. If the clamping force is too low, the printing plate begins to slide between the two clamping surfaces, and it is impossible to achieve a trapezoidal widening of the printing plate through expansion. This is of no problem with respect to the state of the art because, in these conventional devices for clamping the printing plates, the clamping is performed by the pressman with the aid of a tool, for example, a screw spanner or monkey wrench, and the printing plates are therefore clamped with a very great force. Further development in printing-machine construction has led, however, to automation of the plate clamping. The clamping of the printing plate must be performed, in the course of this automation, by automatically actuatable adjusting elements directly or indirectly by means of clamping screws. If one would design these adjusting elements so that the same clamping force is achieved as that which is achievable, for example, with screws which are tightenable by wrenches or spanners, adjusting elements would be required along the entire tensioning rail, which is unnecessary for a normal conventional plate clamping for printing. Such a high clamping force over the entire length of the trailing edge of the printing plate would also not be expedient for a spreading of the trailing edge, because the printing plate cannot expand or stretch in the regions of forcible or strong clamping. With the use of pneumatic adjusting elements, such a high clamping force over the entire trailing edge of the printing plate would require an exceptionally high number of pneumatic cylinders. This would be troublesome and uneconomical.

It is accordingly an object of the invention to provide a method and a device for correcting trapezoidal register deviations even when the clamping force for normal clamping of the trailing edge of the printing plate is too small for a spreading of the printing plate.

With the foregoing and other objects in view, there is provided, in accordance with the invention, a method of correcting trapezoidal register deviations, which includes clamping a trailing edge of a printing plate on a plate cylinder at a plurality of partial sections thereof, making a specimen print for determining register deviations, and correcting register deviations by changing lateral spacing of two of the partial sections engaged in the clamping, and, prior to correcting the register deviations, applying an additional clamping force to the two partial sections, the lateral spacing of which is changed.

In accordance with another aspect of the invention, there is provided a device for performing a method of correcting trapezoidal register deviations comprising an attachment rail for clamping a trailing edge of a printing plate, the attachment rail having a tensioning rail and a clamping rail and being formed of at least two component rail parts, adjusting means for displacing at least one of the component rail parts for changing lateral spacing thereof, and blocking means for applying an additional clamping force to the tensioning rail and the clamping rail.

An advantage of the method and device according to the invention is that the high clamping force must be applied only if such a trapezoidal correction of a register deviation is necessary. Because that is only the case for a few types of paper, the application of a high clamping force for every plate clamping would be uneconomical. Furthermore, the method and device of the invention permits the application of this high clamping force on relatively small regions of the trailing edge of the printing plate, whereby this is achievable with considerably low expense than if the high clamping force has to be applied on the entire clamping surface of the trailing edge of the printing plate. It is possible to apply the high clamping force for correction of the trapezoidal register deviations by relatively simple means, for example, by means of a manual operation. Such an approach is therefore justified in spite of automation, because the correction, as mentioned hereinbefore, is not often required.

An additional object of the invention is to provide an improvement in the method and device for correcting trapezoidal register deviations, in that the stretching of the printing plate does not take place at one location or in a narrowly defined region, but rather, as much as possible, distributed uniformly over a large surface of the printing plate.

In accordance with an added feature of the invention, there are provided a method for correcting the register deviations, applying a clamping force to a third partial section of the trailing edge of the printing plate intermediate the two partial sections thereof, the clamping force applied to the third partial section being of such dimension that the printing plate is capable of being stretched in a respective clamping region of the third partial section.

In accordance with an additional feature of the invention, there are provided a method for adjusting the respective partial section additionally in circumferential direction of the plate cylinder so as to correct an arcuate deformation of the printing plate.

In accordance with yet another feature of the invention, the method includes clamping, unclamping, applying force to and adjustably moving the trailing edge of the printing plate automatically controlled from a control deck or panel.

In accordance with yet a further feature of the invention, there is provided a third component rail part intermediate the two component rail parts, the adjusting means and the blocking means, respectively, comprising an adjusting device and a blocking device for each of the two component rail parts.

In accordance with yet an added feature of the invention, there are provided means for applying a clamping force to at least the third component rail part, during a period wherein the adjusting devices are actuated, for stretching the printing plate in a clamping region of the third component rail part.

In accordance with yet an additional feature of the invention, the adjusting means are formed by an adjusting shaft having an eccentric formation cooperating with the plate cylinder.

In accordance with still another feature of the invention, the attachment rail has a radially outer face with respect to the plate cylinder, and the adjusting shaft is accessible for actuation thereof at the radially outer face of the attachment rail.

In accordance with still a further feature of the invention, the adjusting shaft is formed with a head grippable by a tool at an actuating end of the adjusting shaft.

In accordance with still an added feature of the invention, the blocking means are formed of at least one screw extending through one of the rails and screwed into the other of the rails.

In accordance with still an additional feature of the invention, the blocking means comprise a stop cam actuatable by turning, the stop cam being mounted in the tensioning rail, and a blocking-member counter-bearing firmly connected to the clamping rail and engageable by the stop cam.

In accordance with again another feature of the invention, the blocking-member counter-bearing is formed of a plate held by two screws extending through the tensioning rail and enclosing therebetween a bearing for the stop cam in the clamping rail.

In accordance with again a further feature of the invention, the stop cam has an eccentric cam structure.

In accordance with again an added feature of the invention, the stop cam is formed with a head at an actuating end thereof grippable by a tool.

In accordance with again an additional feature of the invention, the attachment rail has an outer end face, and the blocking means are accessible for actuation thereof from the outer end face of the attachment rail.

In accordance with another feature of the invention, the adjusting means comprise an adjusting shaft formed with a head actuatingly grippable by a tool, and the blocking means comprise a stop cam formed with a head actuatingly grippable by a tool, both of the heads being constructed so as to be actuatingly grippable by the same tool.

In accordance with a further feature of the invention, the attachment rail is formed of a plurality of the tensioning rails respectively assigned to the component rail parts, the tensioning rails having knockout spindles located at respective division surfaces thereof, the tensioning rails being connected to one another by the knockout spindles so as to be fixed against relative rotation, yet axially displaceable.

In accordance with an added feature of the invention, the attachment rail is formed of a plurality of the clamping rails and a plurality of the tensioning rails, the clamping rails being formed of pivotable double levers supported on corresponding tensioning rails of like length, clamping means engaged with the double levers for applying a force thereto, an adjusting element engageable with the double levers for pivoting the double levers against the force of the clamping spring means, the clamping spring means comprising clamping springs disposed around the screws holding the plate, and disposed between the blocking-member counter-bearing and respective ledges formed in the clamping rails.

In accordance with an additional feature of the invention, there are provided drive means for actuating the adjusting means and the blocking means.

In accordance with yet another feature of the invention, the drive means are built into the plate cylinder.

In accordance with yet a further feature of the invention, there are provided drive means for actuating the adjusting means and the blocking means, and wherein the adjusting means are formed by an adjusting shaft having an eccentric formation at an end thereof, the eccentric formation engaging in a slot formed in a radially inner side of the tensioning rail, the slot having axially extending walls engageable by the eccentric formation, the eccentric formation being actuatable via an adjusting shaft by a motor disposed in the plate cylinder.

In accordance with yet an added feature of the invention, the blocking means comprise a stop cam actuatable by a motor disposed in the clamping rail.

In accordance with yet an additional feature of the invention, there are provided counter-stops formed on the component rail parts, respectively, the counter-stops being radially displaceable.

In accordance with still another feature of the invention, there are provided at least one setscrew screwable into a thread formed in the plate cylinder, the counter-stops being displaceable by means of the at least one setscrew.

In accordance with still a further feature of the invention, the setscrew is formed with a head accessible from outside the plate cylinder, the adjusting means comprising an adjusting shaft formed with a head, and the blocking means including a stop cam on a screw having a head, all of the setscrew, the adjusting shaft and the stop-cam screw being actuatable by the heads thereof with a common tool.

In accordance with still an added feature of the invention, there are provided restoring springs arranged between the counter-stops and the plate cylinder for resetting the counter-stops.

In accordance with still an additional feature of the invention, a plurality of the setscrews have respective heads firmly guided in the plate cylinder, and a threaded connection exists with the counter-stops.

In accordance with again another feature of the invention, there is provided a null-portion rail serving as a stop for the counter-stop in a null position thereof.

In accordance with again a further feature of the invention, the counter-stop in the null position engages the null-position rail centrifugally firmly, yet is adjustable centripetally.

In accordance with again an added feature of the invention, the null-position rail is constructed so as to prevent the setscrew from being unscrewed too far.

In accordance with again an additional feature of the invention, the null-position rail covers most of a cylinder gap of the plate cylinder.

In accordance with another feature of the invention, there is provided a motor mounted in the plate cylinder, the setscrew being actuatable by the motor.

In accordance with a further feature of the invention, the drive means comprise a plurality of compressed-air motors.

In accordance with an added feature of the invention, the drive means comprise a plurality of motors, and including transmissions connecting the motors and the adjusting elements.

In accordance with an additional feature of the invention, the transmissions are worm wheel transmissions.

In accordance with yet another feature of the invention, the drive means are located outside the plate cylinder and, in a given position of the plate cylinder, are bringable into an operating position with respective heads of the adjusting means and the blocking means.

In accordance with yet a further feature of the invention, there are provided detectors for determining respective adjusting paths for the adjustable component rail parts.

In accordance with yet an added feature of the invention, the drive means are controllable by pushbutton from a control panel of the printing machine, and including a display for the adjustment paths.

In accordance with a concomitant feature of the invention, the drive means and the detector are operatively connected to a control device for automatically correcting register faults.

Other features which are considered as characteristic for the invention are set forth in the appended claims.

Although the invention is illustrated and described herein as embodied in a method and device for correcting trapezoidal register deviations, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figures 2, 2A:
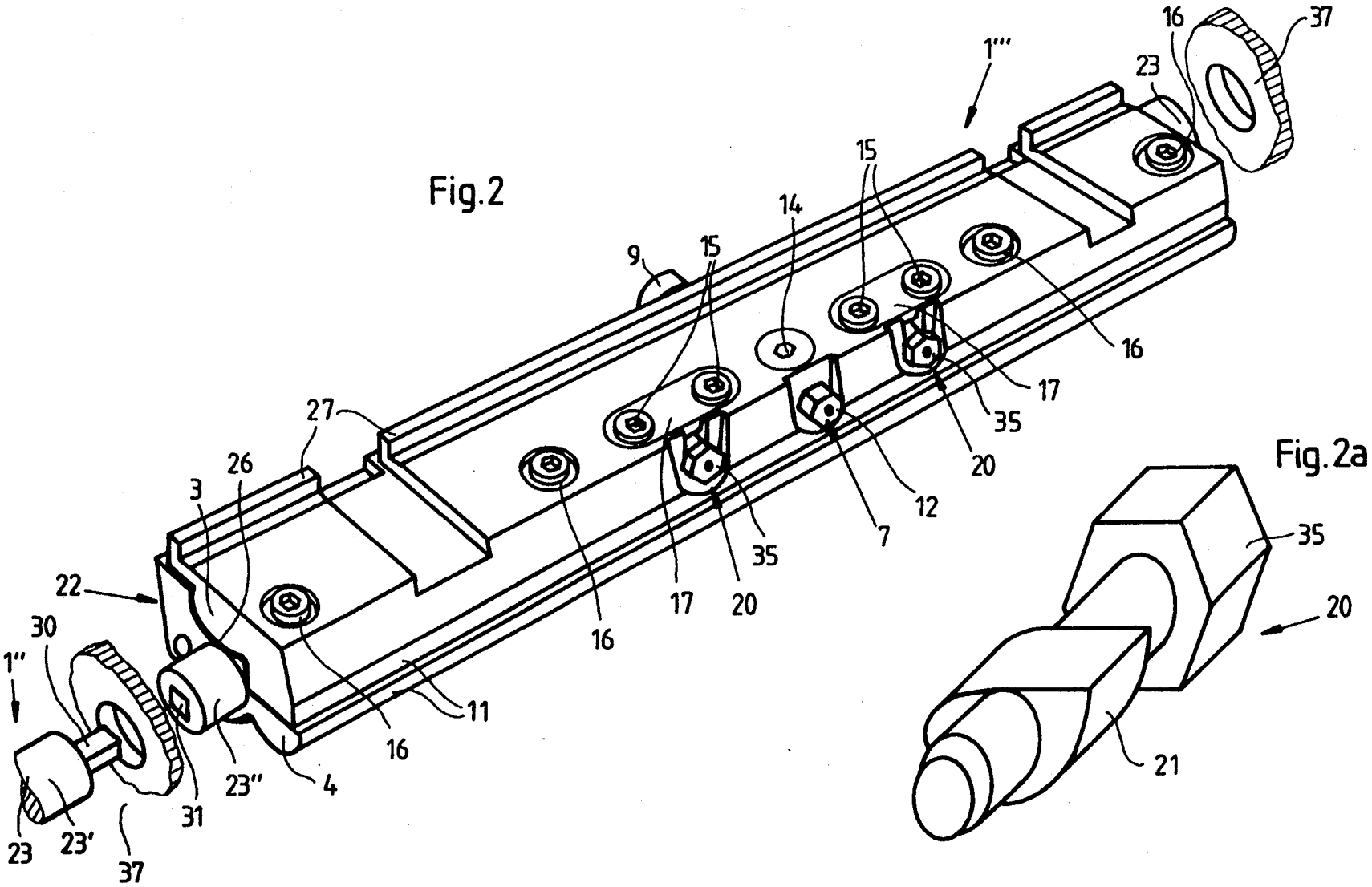
FIG. 2 is a much-enlarged perspective view of one of the component parts of an attachment rail of FIG. 1.
Figure 3:
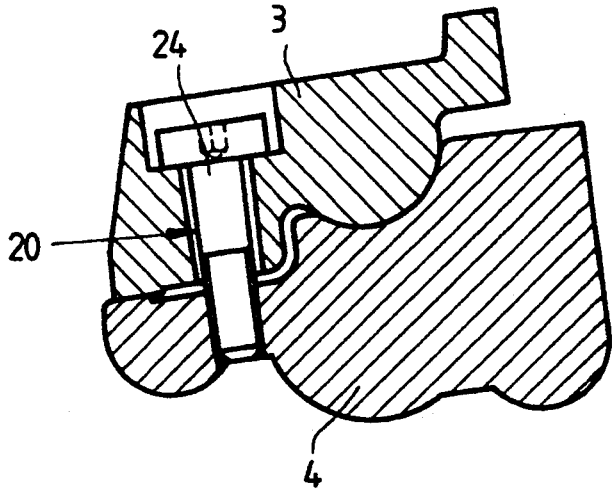
Figure 4:
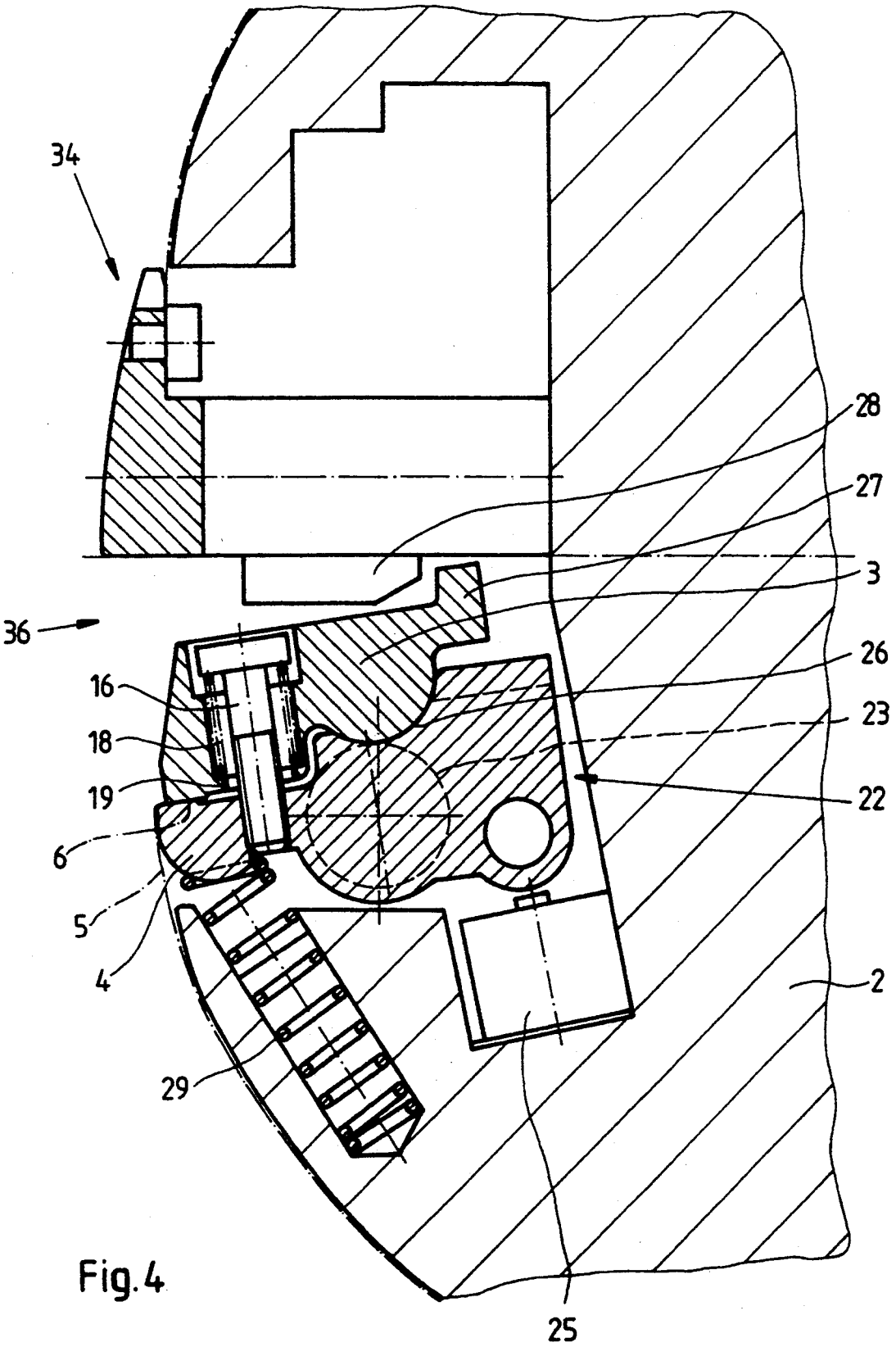
Figure 5:
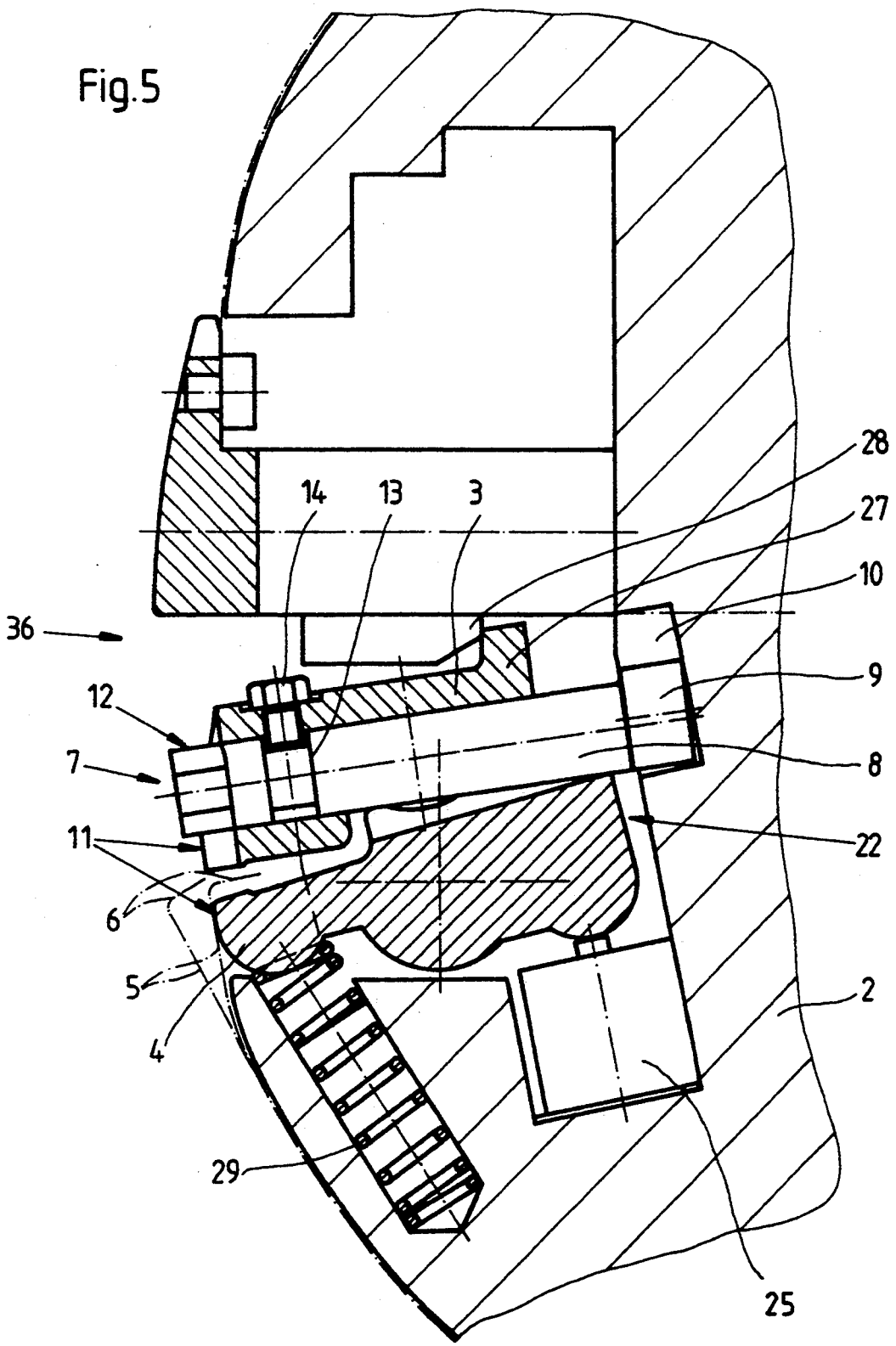
Figure 6:
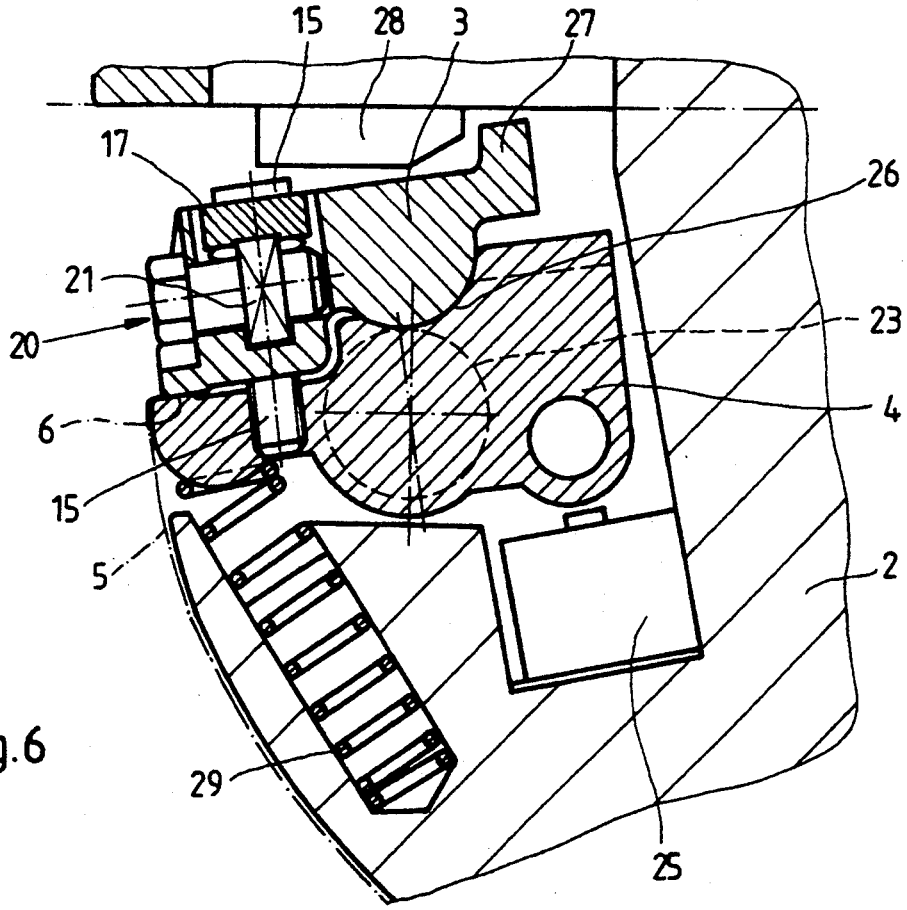
Figure 7:
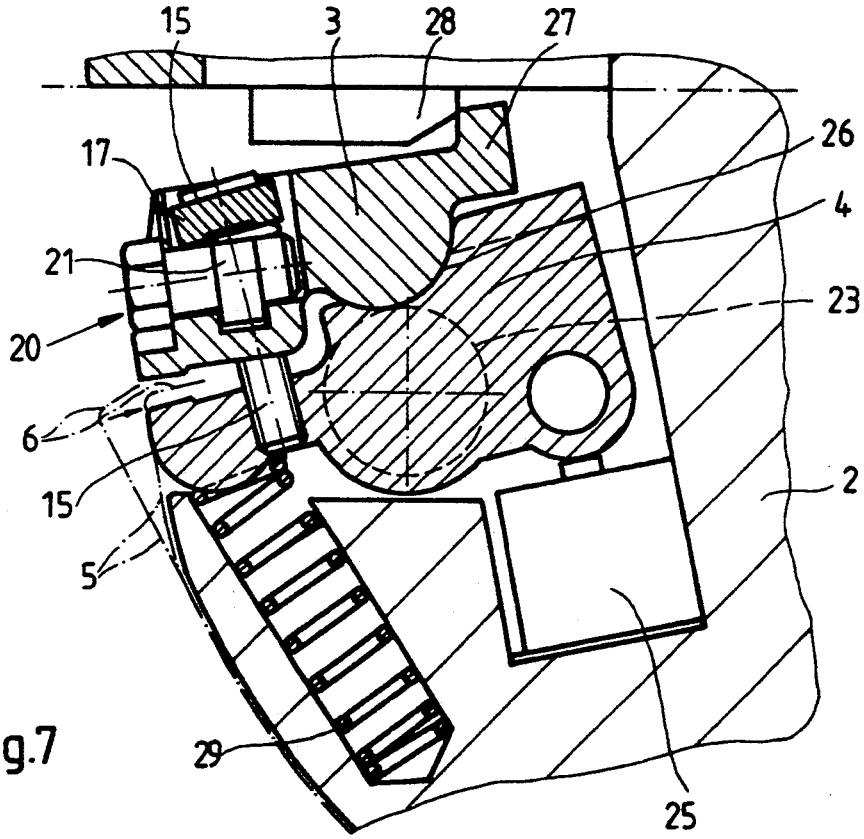
Figure 8:
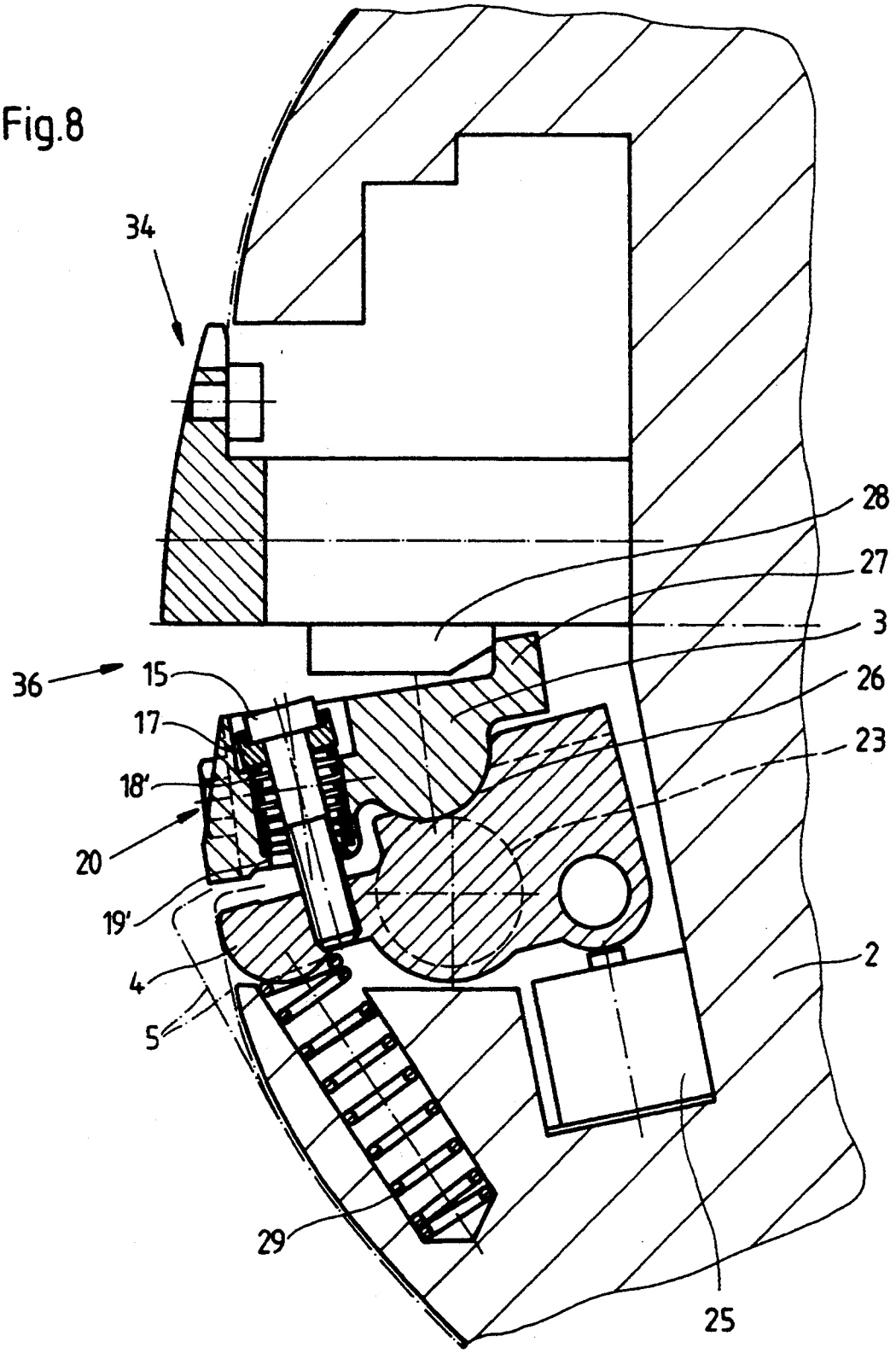
Figure 9:
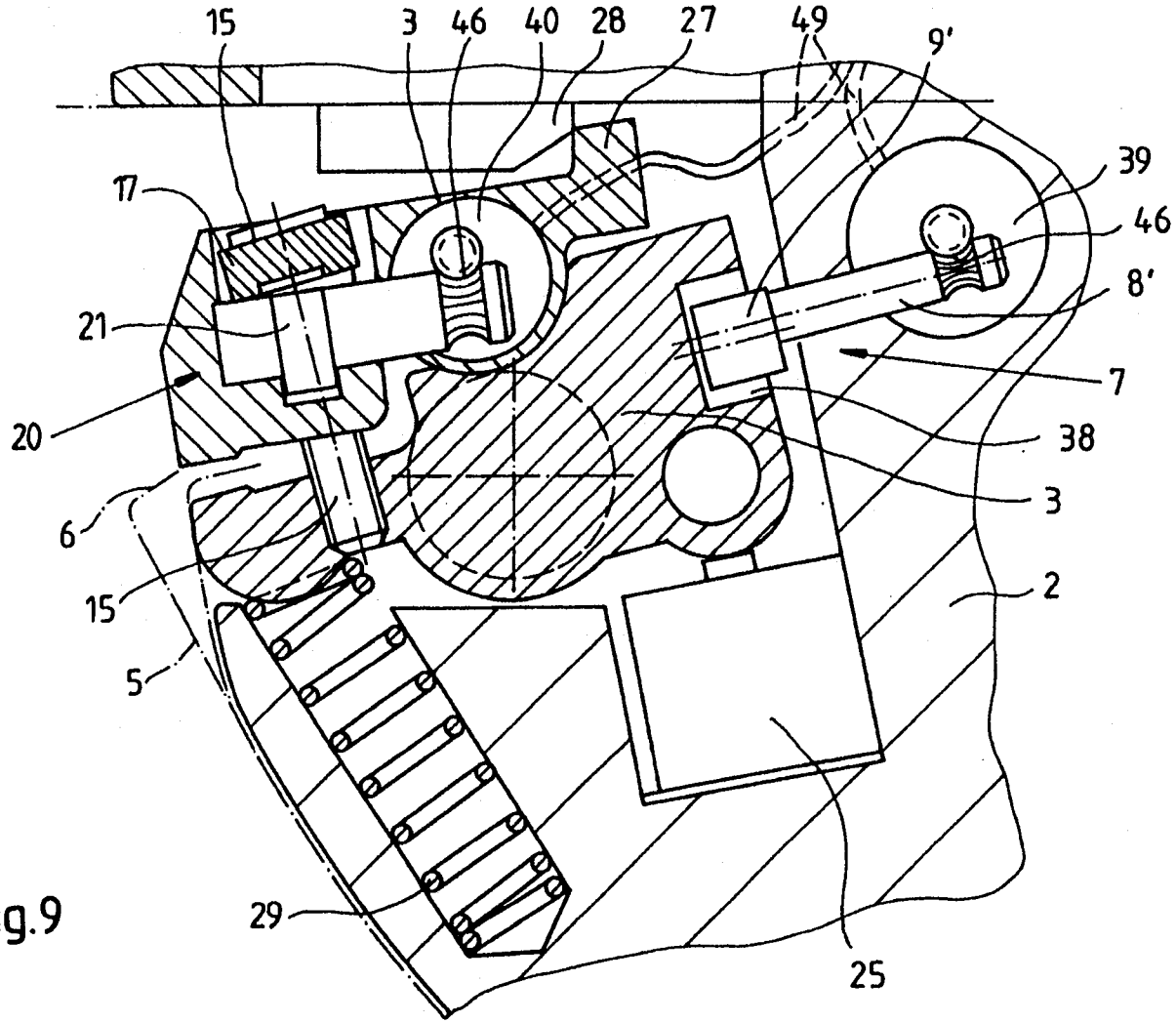
Figure 10:
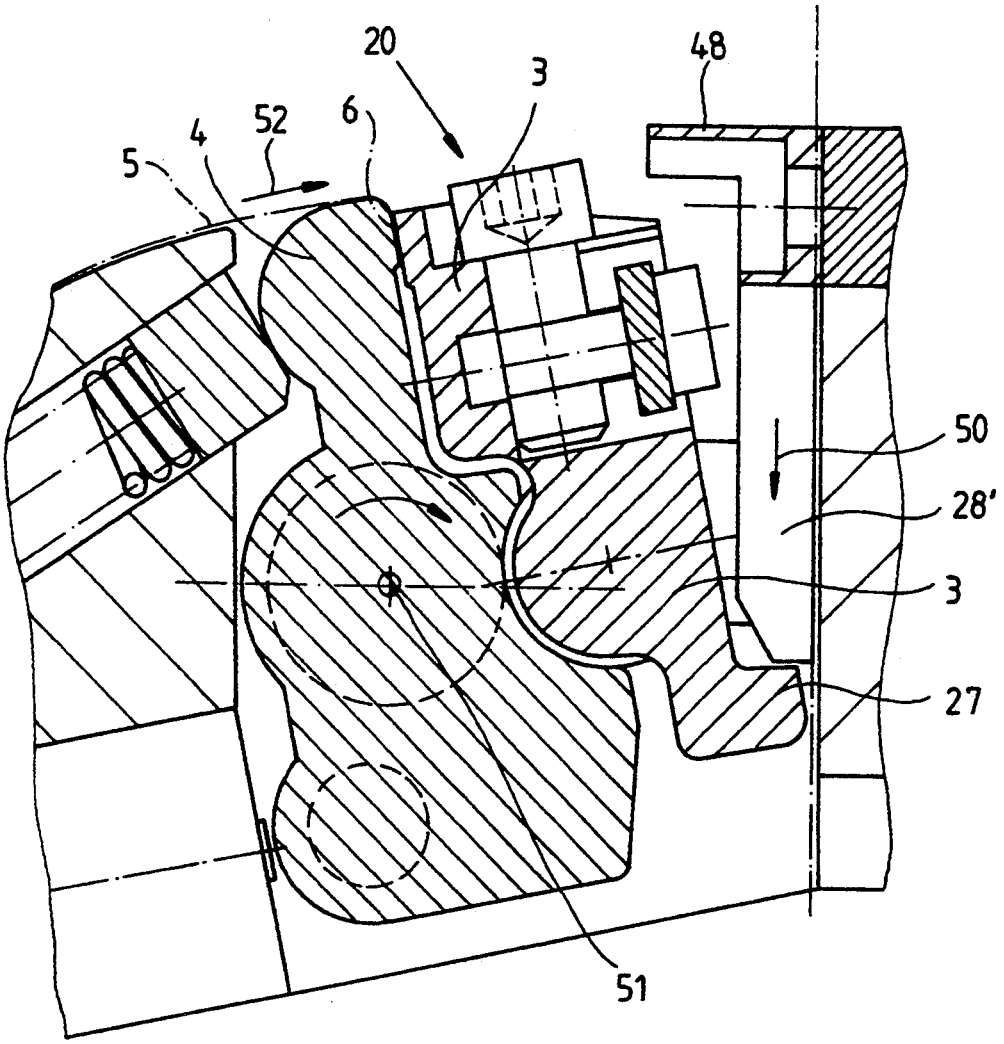
Figure 11:
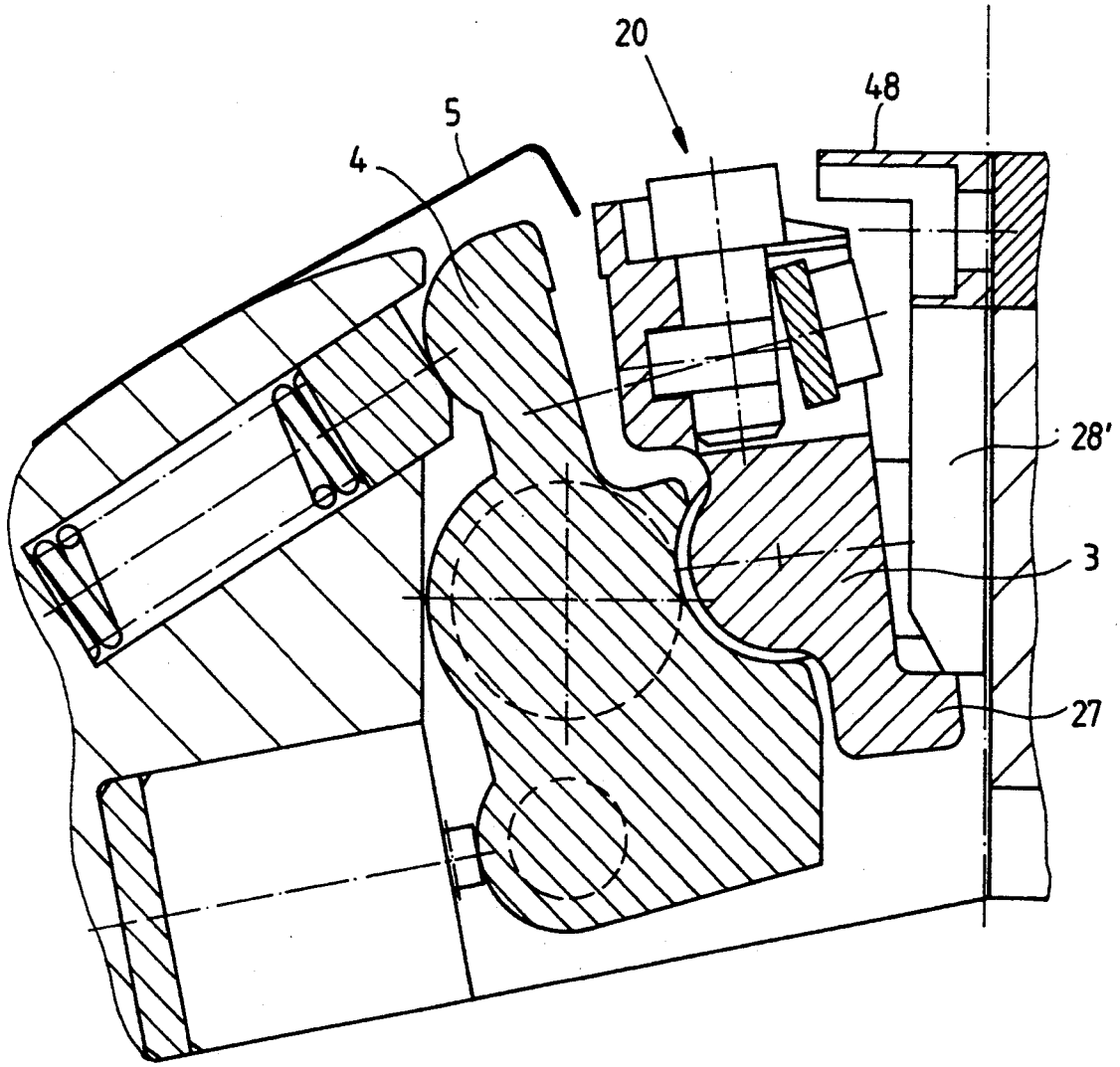
Figure 12:
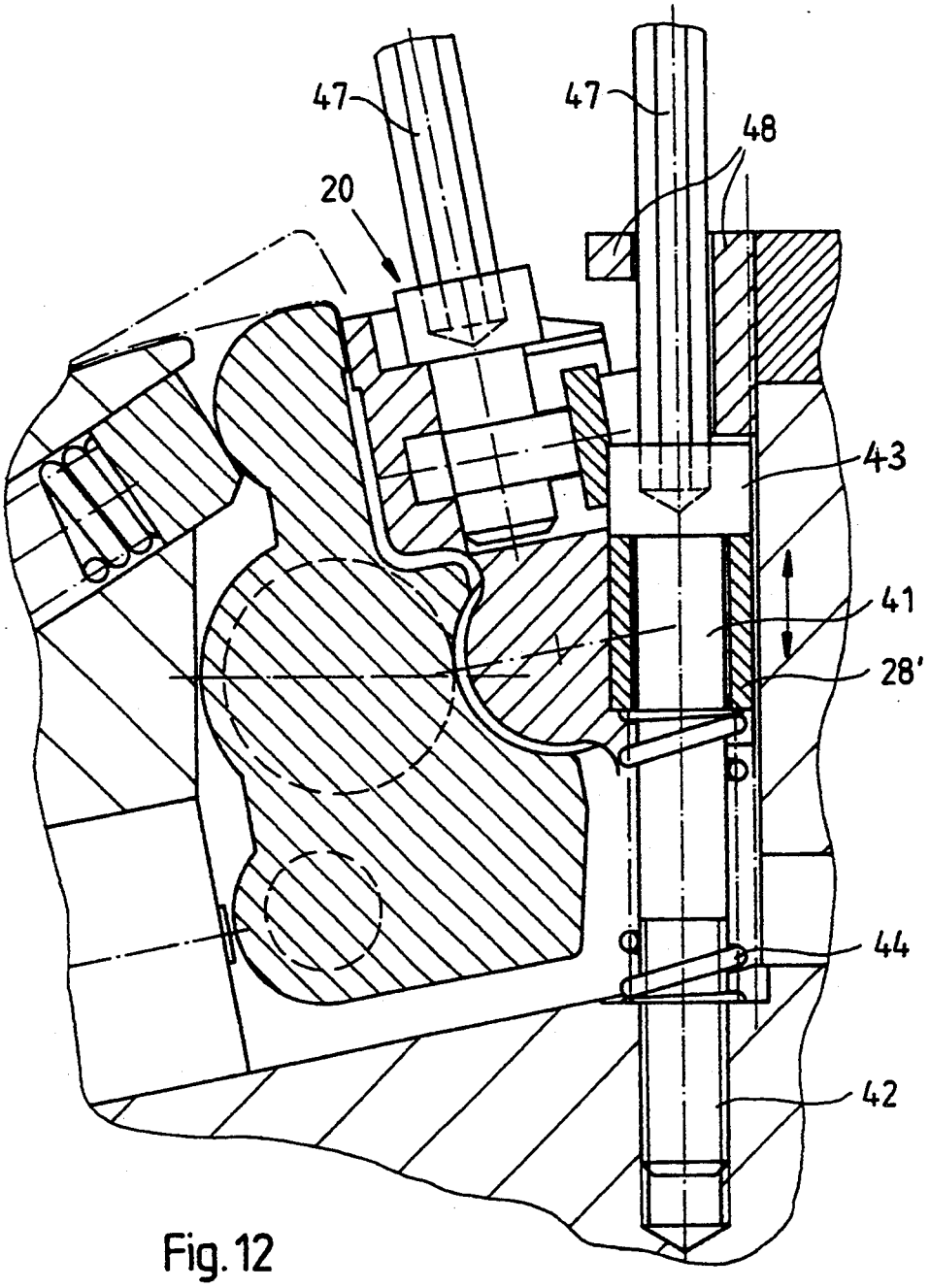
Figure 13:
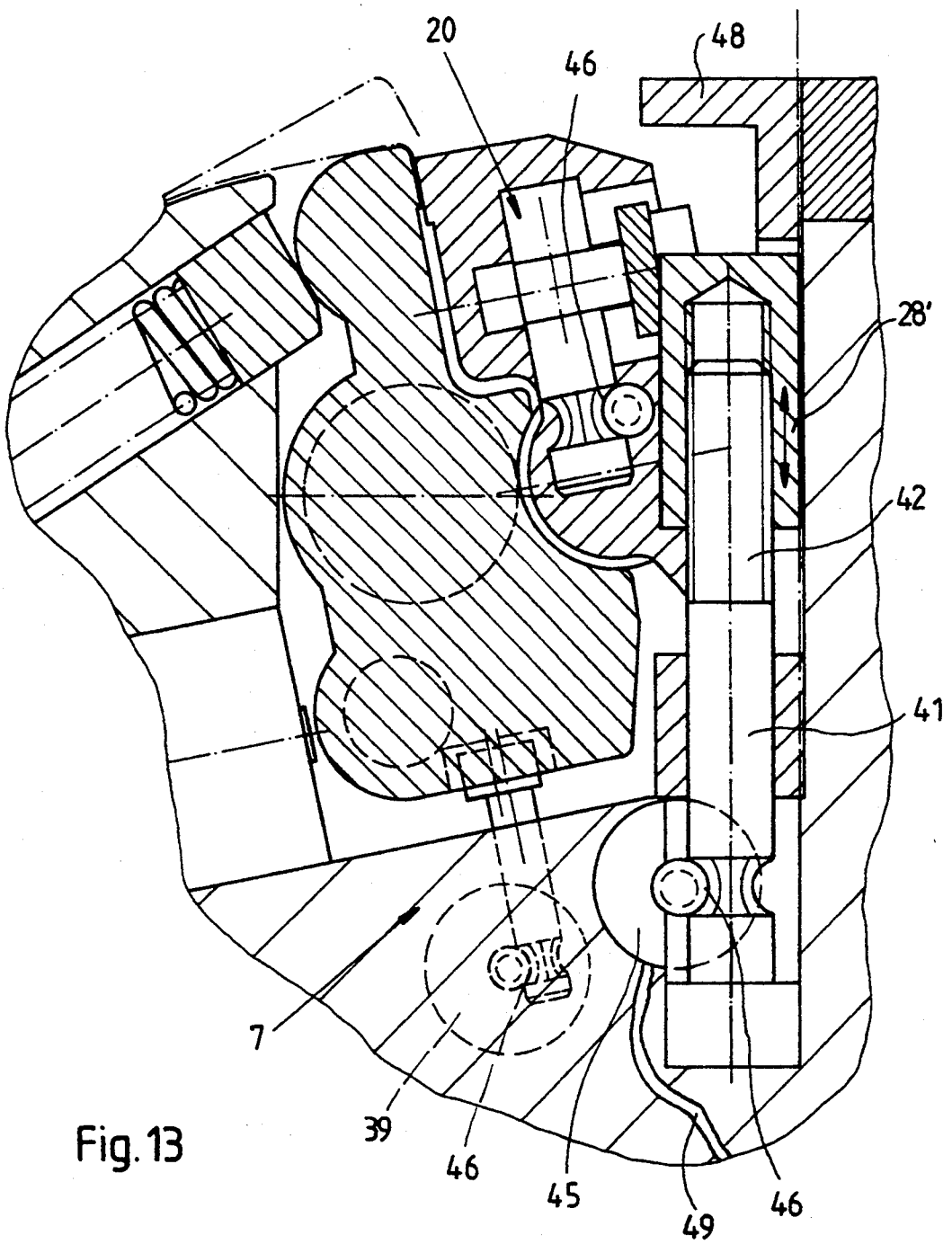

FIG. 2*a* is a much-enlarged detail of FIG. 2 showing in a perspective view a stop cam forming part of the invention;

FIG. 3 is an enlarged cross-sectional view of FIG. 2 showing, in a simple construction, a blocking member according to the invention;

FIG. 4 is a fragmentary cross-sectional view of an automatically actuatable attachment rail according to the invention;

FIG. 5 is a view like that of FIG. 4 showing an adjustment device;

FIGS. 6 and 7 are further views like that of FIG. 4 showing the operation of a blocking member in light of an attachment rail;

FIG. 8 is another view like that of FIG. 4 showing the arrangement of clamping springs in a blocking member;

FIG. 9 is yet another view like that of FIG. 4 showing the construction of an automatically actuatable blocking member and an automatically actuatable adjusting device;

FIG. 10 is an enlarged view similar to that of FIG. 4, rotated through approximately 90° clockwise, of an attachment rail in closed condition with an adjustable counter-stop;

FIG. 11 is a view like that of FIG. 10 wherein the attachment rail is in opened condition with the adjustable counter-stop;

FIG. 12 is another view similar to those of FIGS. 10 and 11 showing the attachment rail with a manually adjustable counter-stop; and FIG. 13 is yet another view like those of FIGS. 10 to 12 showing the attachment rail with an automatically adjustable counter-stop.

Figure 1:
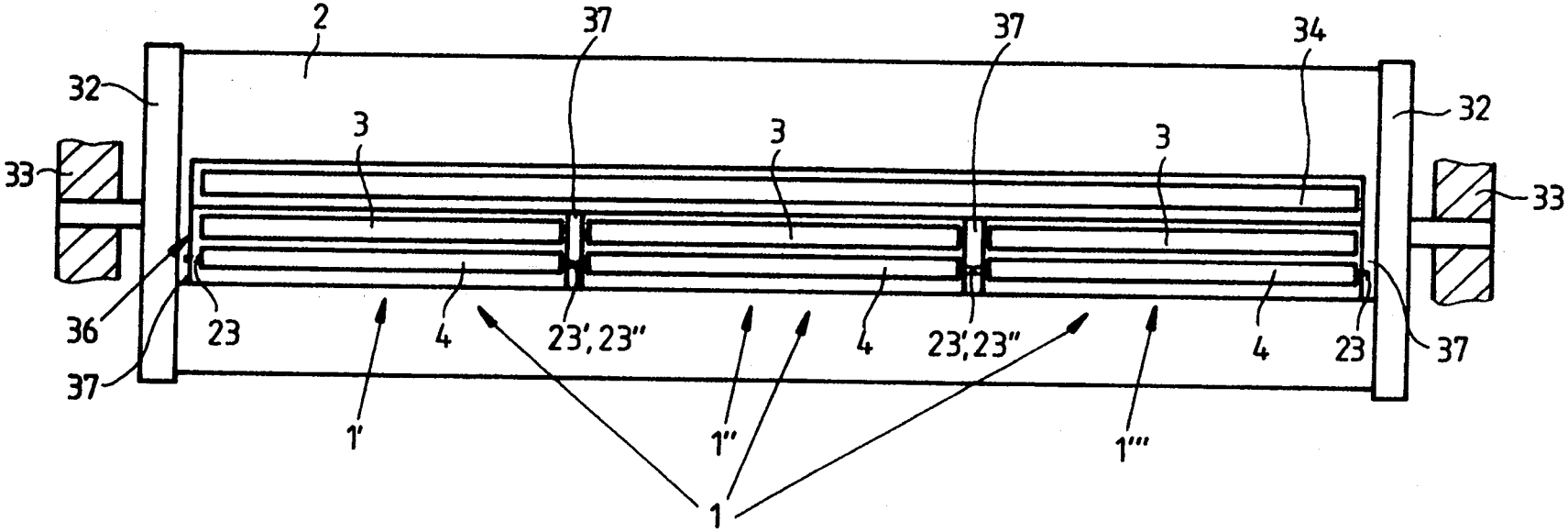
FIG. 1 is a diagrammatic axial view of a printing-plate cylinder with attachment rails formed of a plurality of component parts.

Referring now to the drawings and, first, particularly to FIG. 1 thereof, there is shown therein a printing-plate cylinder 2, journaled in side walls 33 of a printing machine. Between Schmitz rings or cylinder bearers 32, a cylinder gap 36 extends in axial direction and is provided therein with a printing-plate attachment 34 for the front or leading edge of the printing plate, and an attachment rail assembly 1 for the attachment of the rear or trailing edge of the printing plate.

The attachment rail assembly 1 is formed of three attachment rails 1', 1'' and 1''', each of which is formed of a tensioning rail 4 and a clamping rail 3. When a printing plate is mounted or locked onto the plate cylinder 2, an end region of the printing plate is locked between the clamping rail 3 and the tensioning rail 4 and then clamped by a common movement of the clamping rail 3 and the tensioning rail 4 in the tensioning direction of the printing plate. FIG. 1 shows the principle of the invention in a diagrammatic view. In this regard, the specific construction of the clamping rail 3 and the tensioning rail 4 is of no importance with respect to the invention. Only the division of the attachment rail 1 is essential. In the remaining figures of the drawing, nevertheless, details of various embodiments of the invention are shown through which the method of the invention is realizable. The functions are explained with respect to one of the embodiments. The method and device according to the invention may, however, obviously also be realized with other concrete embodiments. The state of the art provides untold possibilities for constructing such attachment rails which, likewise, in accordance with the invention, can be formed of component rail parts, and with which it is also possible to provide adjustment devices and blocking members.

Specific embodiments of the invention are described hereinafter:

FIG. 2 shows for example, an embodiment of a component part 1''' of the attachment rail 1. As indicated, this component rail part 1''' is supported, at an end thereof shown at the right-hand side of FIG. 2, by means of a knockout spindle 23 in a bearing 37 of the plate cylinder 2. At the other end of the component rail part 1''', a knockout spindle 23'' is located, which is also accommodated in a bearing 37 of the plate cylinder 2. In the latter bearing 37, a knockout spindle 23' for a component rail part 1'' is also received. The knockout spindle 23' has a four-corner or rectangular shaft 30 which is inserted into a matching four-corner or rectangular recess 31 formed in the knockout spindle 23''. A simultaneous swiveling movement of the component rail parts 1', 1'' and 1''' of the tensioning rails 4 is thereby assured, which makes it possible simultaneously to effect an axial adjustment of the component rail parts 1' and 1'' in order to produce a change in lateral spacing. The illustrated component rail part 1''' is constructed so that the clamping rail 3, which is in the form of a double lever, is supported on the tensioning rail 4. At a plane of division 22 of the attachment rail 1, it is apparent how the bearing support 26 of the clamping rail 3 on the tensioning rail 4 is formed, as viewed along a sectional plane taken through a surface or cylinder casing and a corresponding counter-surface. Obviously, other bearings, for example, for articulating joints or shafts, are possible. Clamping springs serve to produce the clamping force for locking or mounting a printing plate on a plate cylinder. Screws 16 for fastening or attaching the clamping springs are shown. Under the heads of the screws 15 for blocking-member counter-bearings 17, clamping springs may also be arranged. The mouth-shaped plate receiver formed by the clamping rail 3 and the tensioning rail 4 serves for receiving therein a bent trailing edge 6 of a printing plate 5 (FIG. 4). This mouth-shaped construction is opened against the force of the clamping springs 18 (FIG. 4), so that an adjusting element 25 (FIG. 4) swivels the tensioning rail 4 and, in the course of this swiveling movement, a stop 27 of the clamping rail 3 comes into contact with a counter-stop 28 and, thereby, presses the rear end of the clamping rail 3 in a direction towards the tensioning rail 4 (FIGS. 4 and 5). In this manner, at the radially outward end face 11 (FIG. 2) of the attachment rail 1, a gap is opened mouthlike which receives therein the trailing or rear edge 6 of the printing plate 5. This operation is described in greater detail hereinbelow with respect to the cross-sectional view of FIG. 5.

Essential features of the component rail part 1''', namely an adjusting device 7 and a blocking member 20, are shown in FIG. 2. The adjusting device 7 has an eccentric formation 9, a head 12 grippable by a tool, as well as a holding or check screw 14. Associated with the blocking member 20 is the aforementioned blocking-member counter-bearing 17, the screws 15 for holding the blocking-member counter-bearing 17, as well as a head 35 of a stop cam 21 (FIG. 2*a*). The operation as well as further parts are described hereinafter with regard to the other figures of the drawings. The head 12 of the adjusting device 7 and the heads 35 of the stop cams 21 are advantageously of identical construction, so that the pressman can adjust them with the same tool. In the drawings, the screws all have hexagon heads which can be gripped by the same corresponding wrench.

In FIG. 2*a*, the blocking member 20 is shown as having the construction of a stop cam 21 and as being provided with a hexagon head 35 to be gripped by a suitable wrench. The stop cam 21 is constructed so that, when turned, it presses against the blocking-member counter-bearing 17. The eccentric cam construction of the stop cam 21 serves to adjust the applied pressure or force by means of the turning of the stop cam 21. In this regard, with increased turning of the stop cam 21, an increasing additional clamping force for locking or gripping the bent trailing edge 6 of the printing plate 5 by pressing the clamping rail 3 on the tensioning rail 4 can be applied.

FIG. 3 shows a relatively simple construction of the blocking member 20 which is a possible alternative for the stop cam 21. In the tensioning rail 4, there is formed a threaded bore and, in the clamping rail 3, a through-hole is aligned with the threaded bore in order to insert a screw 24 therein. The head of the screw 24 is accommodated in the countersink formed with a recessed hexagonal hole in the head thereof. With this blocking member 20, the additional clamping force between the clamping rail 3 and the tensioning rail 4 can be attained in the simplest manner by loosening or tightening the screw 24. The provision of a suitable conventional safety device against loosening of the screw and its dropping out is, of course, necessary:

FIG. 4 shows an automatically actuatable attachment rail in a cross-sectional view taken along a plane through the plate cylinder 2 in the vicinity of the cylinder gap 36. The plane of the cross section passes through a component rail part in vicinity of a screw 16 with a clamping spring 18. In the upper region of FIG. 4, a printing-plate fastening device 34 for the leading edge of a printing plate is shown. The clamping rail 4 is, as aforedescribed, rotatably suspended by knockout spindles, the pivot points being indicated by the intersecting phantom lines. At the rear or radially inner end of the tensioning rail 4 in the cylinder gap 36, is an adjusting element 25 constructed, for example, as a pneumatic cylinder. At the forward or radially outer end of the tensioning rail 4, a tensioning spring 29 is provided in a recess formed in the housing of the plate cylinder 2, the spring 29 being compressible by actuation of the adjusting element 25. The clamping rail 3 is supported by means of the bearing 26 on the tensioning rail 4. The clamping rail 3 is provided, in a forward or radially outward region thereof, with a clamping spring 18 inserted into a recess formed in the clamping rail 3 and extending between a ledge 19 and the head of a screw 16 which extends through the recess and is screwed into the tensioning rail 4. Due to the force of the clamping spring 18 applied to the head of the screw 16, this force is transmitted to the tensioning rail 4 which is thereby pressed, in the forward or radially outer region thereof against the clamping rail 3. The bent trailing edge 6 of the printing plate 5 is held in this region serving for clamping. A stop 27 is arranged on the clamping rail 3 for opening this clamping region, the stop 27 cooperating with a counter-stop 28. This cooperation occurs by the adjusting element 25 swiveling the tensioning rail 4 against the clamping spring or springs 29, the stop 27 of the clamping rail 3 then being moved into contact with the counter-stop 28 which is connected with the plate cylinder 2. The instant the stop 27 makes contact, the clamping region opens due to the swiveling of the clamping rail 3 against the force of the clamping springs 18. The bent trailing edge 6 of the printing plate 5 can be inserted. Due to a return or restoration of the adjusting element 25 until the tensioning rail 4 is released, a fact which is illustrated by the intermediate space shown in FIG. 4, for example, located between the actuating member of the adjusting element 25 and the tensioning rail 4, there initially occurs a clamping or gripping of the bent trailing edge 6 of the printing plate 5 and, thereafter, a tensioning or tightening of the printing plate by means of the force of the tension springs 29. FIG. 4 shows the position of a clamped and tensioned or tightened printing plate.

In the following figures of the drawing, there is shown how the device according to the invention is inserted into an attachment rail of the type shown in FIG. 4.

FIG. 5 shows a construction of the adjusting device 7. This view, also, is taken along a cross-sectional plane through the plate cylinder 2 in vicinity of the cylinder gap 36. As illustrated, the adjusting device 7 is shown with its components fully exposed. The adjusting device 7 is formed of an adjusting shaft 8 which is supported in a bore formed in the clamping rail 3. A retaining screw 14 engages in a bore 13 formed in the adjusting shaft 8 in order to fix it in axial direction. The adjusting shaft 8 is formed at its radially inner end with an eccentric formation 9 which cooperates with a stop or abutment surface 10 formed on the housing of the plate cylinder 2, so that when the adjusting shaft 8 is turned, an axially acting force is applied to the clamping rail 3. Because the clamping rail 3 and the tensioning rail 4 are connected with one another, both of the rails 3 and 4 are displaced in axial direction, the bearing of the tensioning rail 4 exhibiting a corresponding play in axial direction. The stop surface 10 must be constructed so that a reverse adjustment is also possible. A non-illustrated fixing of the mutual axial disposition of the clamping and tensioning rails 3 and 4 is provided. At the radially outwardly directed end face 11 of the attachment rail 1, the adjusting shaft 8 is formed with a head 12 grippable by a suitable tool. This serves to effect the adjusting operation. To automate the adjusting operation, provision can be made for an automatic drive having a coupling or clutch for gripping the head 12 of the adjusting shaft 8 and thereby actuating the adjusting device 7. Instead of the head 12, a drive can also be arranged in the plate cylinder 2. It is possible to remotely-control such drives and, by a command from a control panel or a control device, to set the drives into operation.

FIGS. 6 and 7 show the blocking member. Both figures represent a cross-sectional plane through a part of the plate cylinder 2 in vicinity of the cylinder gap 36 so that the blocking member is fully shown. FIG. 6 shows the attachment rail 1 in closed condition, and FIG. 7 in opened condition. The stop cam 21 shown in FIG. 2*a* is supported in the clamping rail 3, the eccentric cam construction cooperating with a blocking-member counter-bearing 17. The blocking-member counter-bearing 17 is formed of a plate held by two screws 15. The screws 15 extend through bores formed in the clamping rail 3 and are screwed into the tensioning rail 4. FIG. 6 shows how the stop cam 21 presses against the blocking-member counter-bearing 17. The force is transmitted via the screws 15 to the tensioning rail 4, so that, by actuating the stop cam 21, the clamping rail 3 and the tensioning rail 4 are pressable together. This condition is shown in FIG. 6.

If a new plate is to be remounted on the plate cylinder 2, the stop cam 21 must be released before actuating the adjusting element 25 for opening the clamping region of the attachment rail 1, so that the stop cam 21 does not block or hinder the opening of the clamping region for inserting the bent trailing edge 6 of the printing plate 5 (note the arrow in FIG. 7).

FIG. 8 shows the arrangement of clamping springs in a blocking member 20. It is possible to arrange clamping springs 18′ also within a blocking member 20. FIG. 8 illustrates this with a cross-sectional view taken along a plane through a plate cylinder 2 in vicinity of an attachment rail 1 wherein the screw 15 for the block-member counter-bearing 17 is freely visible. Shown therein is how such a clamping spring 18′ is inserted between the blocking-member counter-bearing 17 and a ledge 19′. This clamping spring 18′ has the same function as that of the clamping spring 18 shown in FIG. 4. The clamping springs 18′ may be additional clamping springs or, it is possible, for a component rail part, which has blocking members 20 of this type, to arrange the clamping springs 18′ only in the blocking members 20. This depends upon the desired clamping force.

FIG. 9 show the construction of an automatically actuatable blocking member 20 and adjusting device 7.

The blocking member 20 is constructed so that the stop cam lies on a shaft which is connected to a transmission arranged in the clamping rail 3, preferably a worm transmission 46 as well as a motor 40 also arranged in the clamping rail 3. The motor 40 receives its energy as well as its commands via a line 49 leading to a central control. A compressed-air motor may be used for the motor 40, because plate cylinders are provided with compressed-air lines which extend into the plate cylinder in specific positions thereof, and which are connected with a central control. The positions of the plate cylinder in which these compressed-air connections are produced correspond to all positions thereof which are arrived at for changing and tensioning or tightening the printing plates as well as for correcting the position of the printing plates.

The adjusting device 7 is somewhat differently constructed with respect to manual adjustment. The eccentric formation 9′ engages at the radially inner end of the tensioning rail 4 in a slot 38, the long defining walls of which are arranged in circumferential direction so that it is possible that the tensioning rail 4 can perform tensioning movements without being blocked or hampered by the eccentric formation 9′.

On the other hand, the eccentric formation 9′ acts upon the straight walls of the slot 38, during an adjustment, and is capable of adjusting the tensioning rail 4 in axial direction, in this manner. The eccentric formation 9′ is connected with an adjusting shaft 8′ which is supported in bearings in the plate cylinder 2, a transmission being provided at the end of the adjusting shaft 8′ and being preferably constructed as a worm gearing 46. A motor 39 provides for the adjusting movement. This motor 39 is also preferably constructed as a compressed-air motor, and is connected by a line 49 with a central control unit. The remaining parts of FIG. 9 correspond to the aforedescribed features.

FIGS. 10 and 11 show an attachment rail with an adjustable counter-stop 28′ in respective cross-sectional views corresponding to the preceding figures. The counter-stop 28′ has a different construction in that it is slidable in the direction of the arrow 50. If the counter-stop 28′ is disposed against a null or neutral-position rail 48, it is in normal position and it functions in the manner described hereinbefore. Plate clamping occurs also as aforedescribed, in that the clamping rail 3 and the tensioning rail 4 clamp or grip the printing plate and tension or tighten it in circumferential direction. Thereafter, a specimen print is made and, if a trapezoidal register deviation has occurred, the component rail parts 1′ and 1‴ of the attachment rail 1 are axially adjusted in order to correct the register deviation. If it appears from a subsequently processed specimen print that the bent trailing edge 6 of the printing plate 5 which is gripped between the clamping rail 3 and the tensioning rail 4 has deformed in an arcuate manner, this deformation must also be corrected. For this purpose, the counter-stops 28', which are located on both outer component rail parts 1' and 1''' of the attachment rail 1, are offset in the direction of the arrow 50, it being necessary, however, that the blocking members 20 provide for a firm clamping of the printing plate 2, beforehand.

The counter-stops 28', due to the adjustment thereof, press against the stops 27 of both outer component rail parts 1' and 1''', whereby the latter swivel about a pivot point 51. This effects an adjustment in circumferential direction, so that the printing plate 5 is subjected to an additional force in direction of the arrow 52, which corrects the arcuate register deviation of the printing plate 5, in that it stretches or expands the marginal regions of the printing plate 5 to the extent of the deficiency. Before the stretching or expansion of the printing plate 5, which is shown in FIG. 11, the blocking member 20 must again be released or loosened, and the operations correspond to those described hereinbefore. The counter-stop 28' is advantageously withdrawn to the null or neutral position thereof, wherein it engages the null position rail 48 and is thus located in a position for a renewed clamping of a printing plate.

FIG. 12 shows an attachment rail with a manually adjustable counter-stop 28'. The remaining parts of this attachment rail correspond, again, with those of the foregoing embodiments. The counter-stop 28' can be adjusted, in this embodiment, by means of a tool 47, i.e. a hexagonal socket screw wrench or pin spanner, with the aid of a setscrew 41. A lower part of the setscrew 41 is screwed into a thread 42 formed in the plate cylinder 2. A restoring spring 44 assures that the counter-stop 28' is set back when the setscrew 41 is screwed out. In this embodiment, the null or neutral position is attained when the head of the setscrew 41 engages the null-position rail 48. If the setscrew 41 is turned clockwise with a wrench 47, the counter-stop 28' travels away from the null-position rail 48 in a direction towards the middle of the cylinder. This adjustment serves to correct the arcuate register deviations described hereinbefore. By turning the setscrew 41 counter-clockwise, the restoring spring 44 forces the counter-stop 28' back again until the null or neutral position is reached. The null-position rail 48 simultaneously prevents the unscrewing of the setscrew 41. Moreover, the null-position rail 48 ensures that the cylinder gap is covered as much as possible.

FIG. 13 shows an attachment rail which, in a manner different from the embodiment of FIG. 12, is furnished with automatic actuating devices for the blocking member 20, the adjusting device 7 and the setscrew 41. The automatic actuating devices for the adjusting device and the blocking member 20 correspond to those which have been described hereinbefore. The setscrew 41 is screwed into the counter-stop 28' and is turnably mounted in the cylinder 2 yet fixed against axial displacement relative thereto. The setscrew 41 is provided thereat with a worm wheel which is drivable by a motor 45 via a worm. The motor 45 may also be a compressed-air motor, preferably, which is connected by a line 49 to a central control.

We claim:

1. Device for correcting trapezoidal register deviations comprising an attachment rail for clamping a trailing edge of a printing plate on a printing plate cylinder, said attachment rail having a tensioning rail assembly and a clamping rail assembly, each assembly being formed respectively of at least two clamping rails, and two tensioning rails, adjusting means connected with said clamping rail assembly for lateral displacement relative to said plate cylinder of at least one of said clamping rails, and blocking means connected with said clamping rail assembly for applying a clamping force to said tensioning rail assembly and said clamping rail assembly; including at least a further tensioning rail intermediate said two tensioning rails, and at least a further clamping rail intermediate said two clamping rails, said adjusting means and said blocking means, respectively, including an adjusting device and a blocking device for each of said two clamping rails, wherein said further clamping rail and said further tensioning rail is rotatably coupled to at least one of said respective clamping rails and tensioning rails.

2. Device according to claim 1, including means for applying a further clamping force to at least one of said further tensioning and clamping rails, during a period wherein said adjusting devices are actuated, for stretching the printing plate in a clamping region of said further tensioning rail and said further clamping rail.

3. Device for correcting trapezoidal register deviations comprising an attachment rail for clamping a trailing edge of a printing plate on a printing plate cylinder, said attachment rail having a tensioning rail assembly and a clamping rail assembly, each assembly being formed respectively of at least two clamping rails, and two tensioning rails, adjusting means connected with said clamping rail assembly for lateral displacement relative to said plate cylinder of at least one of said clamping rails, and blocking means connected with said clamping rail assembly for applying a clamping force to said tensioning rail assembly and said clamping rail assembly; wherein said adjusting means include at least one screw disposed in a bore in said attachment rail, a stop cam extending from said screw, a recess in said rotary cylinder for receiving said stop cam, and a stop surface in said recess in operative engagement with said cam for effecting said displacement upon turning of said screw.

4. Device according to claim 3, wherein said stop surface is formed of a plate held by two screws extending through said tensioning rail assembly and enclosing therebetween a bearing for said stop cam in said clamping rail assembly.

5. Device according to claim 3, wherein said stop cam has an eccentric cam structure.

6. Device according to claim 3, wherein said stop cam is formed with a head at an actuating end thereof grippable by a tool.

7. Device for correcting trapezoidal register deviations comprising an attachment rail for clamping a trailing edge of a printing plate on a printing plate cylinder, said attachment rail having a tensioning rail assembly and a clamping rail assembly, each assembly being formed respectively of at least two clamping rails, and two tensioning rails, adjusting means connected with said clamping rail assembly for lateral displacement relative to said plate cylinder of at least one of said clamping rails, and blocking means connected with said clamping rail assembly for applying a clamping force to said tensioning rail assembly and said clamping rail assembly; wherein said attachment rail includes a plurality of said tensioning rails respectively aligned with said clamping rails, said tensioning rails having knockout spindles located at respective facing end surfaces of the tensioning rails, said tensioning rails being connected to one another by said knockout spindles so as to be fixed against mutual relative rotation, yet being mutually axially displaceable.

8. Device for correcting trapezoidal register deviations comprising an attachment rail for clamping a trailing edge of a printing plate on a printing plate cylinder, said attachment rail having a tensioning rail assembly and a clamping rail assembly, each assembly being formed respectively of at least two clamping rails, and two tensioning rails, adjusting means connected with said clamping rail assembly for lateral displacement relative to said plate cylinder of at least one of said clamping rails, and blocking means connected with said clamping rail assembly for applying a clamping force to said tensioning rail assembly and said clamping rail assembly; including a further stop cam extending from each said clamping rail in direction substantially perpendicular to a radius of said plate cylinder, and at least one counter-stop formed on said printing cylinder, said counter-stop being radially displaceable in positions in and out of alignment with said further stop cam.

9. Device according to claim 8, including at least one setscrew screwable into a thread formed in the plate cylinder in operative engagement with said counter-stop, said counter-stop being displaceable by means of said at least one setscrew.

10. Device according to claim 9, wherein said setscrew is formed with a head accessible from outside the plate cylinder, said adjusting means comprising an adjusting shaft formed with a head, and said blocking means including a counter stop screw having a screw head in operative engagement with said counter stop, said setscrew, said adjusting shaft and said screw being actuatable by said screw heads thereof with a common tool.

11. Device according to claim 9, including restoring springs arranged between said counter-stop and the plate cylinder for restoring said counter-stop after unscrewing said setscrew.

12. Device according to claim 9, including a plurality of counter-stops, and a plurality of said setscrews having respective heads firmly guided in the plate cylinder, and having a threaded connection with said counter-stops.

13. Device according to claim 8, including a null-position rail having a stop for said counter-stop in a null position thereof.

14. Device according to claim 13, wherein said counter-stop has a null position in engagement with said null-position rail.

15. Device according to claim 14, including at least one setscrew screwable into a thread formed in the plate cylinder in operative engagement with said counter-stop, and wherein said null-position rail includes means for preventing said setscrew from being unscrewed beyond its threaded range.

16. Device according to claim 13, including a cylinder gap in said plate cylinder wherein said null-position rail covers substantially all of said cylinder gap.

* * * * *